US008246763B2

(12) United States Patent
Yamada et al.

(10) Patent No.: US 8,246,763 B2
(45) Date of Patent: Aug. 21, 2012

(54) HIGH STRENGTH ALUMINUM ALLOY CASTING AND METHOD OF PRODUCTION OF SAME

(75) Inventors: Kouji Yamada, Okazaki (JP); Tomoyuki Hatano, Nagoya (JP); Susumu Miyakawa, Anjyo (JP); Hiromi Takagi, Nagoya (JP); Hiroshi Horikawa, Shizuoka (JP); Akio Hashimoto, Numazu (JP)

(73) Assignees: Denso Corporation, Kariya (JP); Nippon Light Metal Co., Ltd., Tokyo (JP)

( * ) Notice: Subject to any disclaimer, the term of this patent is extended or adjusted under 35 U.S.C. 154(b) by 0 days.

(21) Appl. No.: 12/798,288

(22) Filed: Apr. 1, 2010

(65) Prior Publication Data

US 2010/0192888 A1 Aug. 5, 2010

Related U.S. Application Data

(62) Division of application No. 11/986,853, filed on Nov. 27, 2007, now abandoned, which is a division of application No. 10/650,897, filed on Aug. 28, 2003, now abandoned.

(30) Foreign Application Priority Data

Aug. 29, 2002 (JP) ..... 2002-251956
Aug. 29, 2002 (JP) ..... 2002-251984

(51) Int. Cl.
*C22C 21/04* (2006.01)

(52) U.S. Cl. ..... 148/417; 420/534; 420/535; 420/549

(58) Field of Classification Search ..... 148/417; 420/534, 535, 548, 549
See application file for complete search history.

(56) References Cited

U.S. PATENT DOCUMENTS

| | | | | |
|---|---|---|---|---|
| 3,765,877 | A | 10/1973 | Sperry et al. | |
| 5,162,065 | A * | 11/1992 | Scott et al. | 148/438 |
| 5,484,492 | A | 1/1996 | Rogers et al. | |
| 5,722,036 | A | 2/1998 | Shikata et al. | |
| 5,993,576 | A | 11/1999 | Ichinose et al. | |
| 6,918,970 | B2 | 7/2005 | Lee et al. | |

FOREIGN PATENT DOCUMENTS

DE 2 347 059 9/1973

(Continued)

*Primary Examiner* — Roy King
(74) *Attorney, Agent, or Firm* — Harness, Dickey & Pierce, P.L.C.

(57) ABSTRACT

A high strength aluminum alloy casting obtained by casting an aluminum alloy comprised of 7.5 to 11.5 wt % of Si, 3.8 to 4.8 wt % of Cu, 0.45 to 0.65 wt % of Mg, 0.4 to 0.7 wt % of Fe, 0.35 to 0.45 wt % of Mn, and the balance of Al and not more than 0.2 wt % of unavoidable impurities, wherein this aluminum alloy has 0.1 to 0.3 wt % of Ag added to it or contains 0.1 to 1.0 wt % of at least one element selected from the group of second additive elements comprised of Rb, K, Ba, Sr, Zr, Nb, Ta, V, and Pd and rare earth elements, and a method of production of a high strength aluminum alloy casting comprising the steps of filling a melt of an aluminum alloy in a mold to obtain a casting, taking out the aluminum alloy casting from the mold, solubilizing the high strength aluminum alloy casting by heating in a temperature range of 495 to 505° C. for 2 to 6 hours, quenching the high strength aluminum alloy casting after the solubilization, and age hardening the high strength aluminum alloy casting by heating in a temperature range of 160 to 220° C. for 2 to 6 hours after quenching.

13 Claims, 13 Drawing Sheets

FOREIGN PATENT DOCUMENTS

| | | | | |
|---|---|---|---|---|
| JP | 57149445 | A | * | 9/1982 |
| JP | 64-39339 | | | 2/1989 |
| JP | 9-256127 | | | 9/1997 |
| JP | 2000-192180 | | | 7/2000 |
| JP | 2000192180 | A | * | 7/2000 |
| WO | WO 9610099 | A1 | * | 4/1996 |

* cited by examiner

RELATIVE STRENGTH
(STRENGTH INDEXED TO Cu=0)

RELATIVE STRENGTH
(STRENGTH INDEXED TO Mg=0)

RELATIVE STRENGTH
(STRENGTH INDEXED TO Mn=0)

EUTECTIC Si INGREDIENT

T6 TREATMENT
COMPARATIVE EXAMPLE

EUTECTIC Si INGREDIENT

T6 (NCDE ADDED)
INVENTION EXAMPLE
(LARGE EFFECT OF INCREASED
FINENESS OF DISPERSION)

INVENTION
EXAMPLE (T6)
(NCDE ADDED)

COMPARATIVE
EXAMPLE (T6)
(NCDE NOT ADDED)

INVENTION EXAMPLE (T6) -NCDE ADDED

COMPARATIVE EXAMPLE (T6)

HIGH STRENGTH ALUMINUM ALLOY CASTING AND METHOD OF PRODUCTION OF SAME

CROSS-REFERENCE TO RELATED APPLICATIONS

This application is a divisional Application of U.S. patent application Ser. No. 11/986,853 filed on Nov. 27, 2007, abandoned, which is a divisional Application of U.S. patent application Ser. No. 10/650,897 filed on Aug. 28, 2003, abandoned. This application claims the benefit of JP 2002-251956 filed Aug. 29, 2002 and JP 2002-251984 filed Aug. 29, 2002. The disclosures of the above applications are incorporated herein by reference.

BACKGROUND OF THE INVENTION

1. Field of the Invention

The present invention relates to a high strength aluminum alloy casting having superior mechanical properties, a high strength aluminum alloy casting including a neutralizing casting defect element for increasing the strength (hereinafter also referred to as an "NCDE"), and parts made from this high strength aluminum alloy casting such as a scroll for a compressor for an air-conditioner, a vane rotor of a valve timing regulating device, and a housing of an antilock braking system. Further, the present invention relates to a method of production of the above high strength aluminum alloy casting, a method of production of a high strength aluminum alloy casting including a neutralizing casting defect element, and a method of production of parts made from this high strength aluminum alloy casting such as a scroll for a compressor of an air-conditioner, a vane rotor of a valve timing regulating device, and a housing of an antilock braking system.

2. Description of the Related Art

As prior die casting technology relating to increasing the strength of a scroll made of an aluminum alloy casting, as disclosed in Japanese Unexamined Patent Publication (Kokai) No. 9-256127, there is a method of water cooling or age hardening a cast or die-cast scroll die casting immediately after releasing it from the die. That is, the method of production of the die casting in Japanese Unexamined Patent Publication (Kokai) No. 9-256127 adjusts the contents of the precipitation hardening elements Cu and Mg in the elements contained in the aluminum alloy and performs water quenching and age hardening so as to improve the state of precipitation of Cu and Mg and enhance the strength of these alloys. Further, in the method of production, it was confirmed that the tensile strength, yield strength, and fatigue strength of the die castings were enhanced, but these aluminum alloy die castings have casting structures formed as meshes, so were inferior in properties compared with aluminum alloy die castings solubilized and age hardened to make the eutectic Si spherical (T6 treatment).

Further, Japanese Unexamined Patent Publication (Kokai) No. 2000-192180 discloses a die casting of aluminum alloy having a chemical composition resembling the above and a method of production of the same. This method of production tries to improve the strength of the die casting by suppressing the amount of gas included in the die casting of the aluminum alloy and solubilizing the alloy. However, aluminum alloy scrolls provided in air-conditioners in recent years have changed along with the higher efficiency of air-conditioning and changes in the refrigerant used. With just the improvements of the method of production described in Japanese Unexamined Patent Publication (Kokai) No. 2000-192180, it is not possible to satisfy the design requirements of aluminum alloy scrolls.

SUMMARY OF THE INVENTION

An object of the present invention is to provide a high strength aluminum alloy casting keeping down capital costs, raising productivity, extending the lifetime of the casting or die casting mold, and reducing the cost of the product. Another object of the present invention is to provide a high strength aluminum alloy casting improving the tensile strength, yield strength, fatigue strength, etc. of the aluminum alloy casting, reducing casting defects, and increasing the fineness of dispersion of the structure. Still another object of the present invention is to provide a scroll for an air-conditioner, a vane rotor of a valve timing regulating device, and a housing of an antilock braking system made from this high strength aluminum alloy casting. A still further object of the present invention is to provide a method of production of this high strength aluminum alloy casting.

According to a first aspect of the present invention, there is provided a high strength aluminum alloy casting obtained by casting an aluminum alloy comprised of 7.5 to 11.5 wt % of Si, 3.8 to 4.8 wt % of Cu, 0.45 to 0.65 wt % of Mg, 0.4 to 0.7 wt % of Fe, 0.35 to 0.45 wt % of Mn, and the balance of Al and not more than 0.2 wt % of unavoidable impurities, wherein 0.1 to 0.3 wt % of Ag is added to this aluminum alloy.

According to a second aspect of the present invention, there is provided a high strength aluminum alloy casting obtained by casting an aluminum alloy comprised of 7.5 to 11.5 wt % of Si, 3.8 to 4.8 wt % of Cu, 0.45 to 0.65 wt % of Mg, 0.4 to 0.7 wt % of Fe, 0.35 to 0.45 wt % of Mn, and the balance of Al and not more than 0.2 wt % of unavoidable impurities, wherein this aluminum alloy contains 0.1 to 1.0 wt % of at least one element selected from the group of second additive elements comprised of Rb, K, Ba, Sr, Zr, Nb, Ta, V, and Pd and rare earth elements.

Preferably, an amount of gas included in the high strength aluminum alloy casting is kept to not more than 1.5 $cm^3$ with respect to 100 g of the high strength aluminum alloy casting, and solubilization and age hardening are performed to enhance the strength.

Preferably, when casting or die casting, the rare earth element reacts with molten hydrogen in the aluminum alloy to form a compound and suppress casting defects arising due to the molten hydrogen.

Preferably, the rare earth element is at least one element selected from the group comprising La, Ce, Pr, Nb, Pm, Sm, Eu, Ga, Tb, Dy, Ho, Er, Tm, Yb, Lu, Y, and Sc.

Preferably, the high strength aluminum alloy casting is solubilized by heating in a temperature range of 495 to 505° C. for 2 to 6 hours, then quenched and further then age hardened by heating in a temperature range of 160 to 220° C. for 2 to 6 hours.

More preferably, the solubilized and age hardened high strength aluminum alloy casting has eutectic Si of a particle size of an average not more than 15 μm preferably not more than 12 μm, a Cu compound of a particle size of not more than an average 8 μm, an Mg—Si compound of a particle size of not more than an average 12 μm, and an Fe compound of a particle size of not more than an average 6 μm.

According to a third aspect of the present invention, there is provided a method of production of a high strength aluminum alloy casting comprising the steps of filling a melt of an aluminum alloy in a mold to obtain a casting, taking out the aluminum alloy casting from the mold, solubilizing the high strength aluminum alloy casting by heating in a temperature range of 495 to 505° C. for 2 to 6 hours, quenching the high strength aluminum alloy casting after the solubilization, and age hardening the high strength aluminum alloy casting by heating in a temperature range of 160 to 220° C. for 2 to 6 hours after quenching.

Preferably, the method of production is a die cast method and further comprises the steps of closing mold halves, pouring aluminum melt into a melt sleeve of a die cast machine, then using an injection plunger to close a melt pouring inlet of the die cast machine and reducing the pressure in the mold to not more than 13.3 kPa and filling a high strength aluminum alloy in the mold after reducing the pressure.

Alternatively, the method of production is a die cast method and further comprises the steps of closing mold halves, pouring aluminum melt into a melt sleeve of a die cast machine, then using an injection plunger to close a melt pouring inlet of the die cast machine and reducing the pressure in the mold to not more than 13.3 kPa, adjusting the atmosphere by blowing in oxygen of a pressure of at least atmospheric pressure, and filling a high strength aluminum alloy in the mold after adjusting the pressure.

Alternatively, the method of production is a die cast method and further comprises the step of closing mold halves, pouring aluminum melt into a melt sleeve of a die cast machine, then using low speed die casting to fill high strength aluminum alloy into the mold while advancing an injection plunger at a low speed so as to keep air and heat decomposition gas produced from a release agent etc. from being entrained.

A scroll for a compressor of an air-conditioner made from one of the above high strength aluminum alloy castings.

A method of production of a scroll for a compressor of an air-conditioner made from a high strength aluminum alloy casting, comprising the steps of reducing the pressure inside the mold to not more than 13.3 kPa and filling the mold with a high strength aluminum alloy after reduction of pressure for die casting.

Preferably, the method further comprises the steps of adjusting the atmosphere by blowing oxygen of a pressure of at least atmospheric pressure into the mold after the step of reducing the pressure inside the mold to not more than 13.3 kPa and filling the high strength aluminum alloy into the mold for die casting after adjusting the atmosphere.

A method of production of a scroll for a compressor of an air-conditioner using one of the above method of productions.

A vane rotor of a valve timing regulating device provided in a drive transmission system made from one of the above high strength aluminum alloy castings.

A housing of an antilock braking system made from one of the above high strength aluminum alloy castings.

BRIEF DESCRIPTION OF THE DRAWINGS

These and other objects and features of the present invention will become clearer from the following description of the preferred embodiments given with reference to the attached drawings, wherein:

FIG. 2A shows the relative tensile strength and FIG. 2B shows the relative fatigue strength;

FIGS. 3A to 3C show the improvement in strength of the aluminum alloy of a basic composition by adjusting and adding Cu, Mg, and Mn, wherein FIG. 3A shows the addition of Cu, FIG. 3B shows the addition of Mg, and FIG. 3C shows the addition of Mn;

FIGS. 4A and 4B show the relationship between the content of the ingredient elements and relative strength, wherein FIG. 4A shows the case of Cu and FIG. 4B shows the case of Mg;

FIGS. 6A and 6B show structures of aluminum alloy treated in various ways as observed by EPMA, wherein FIG. 6A shows a comparative example wherein the aluminum alloy is only subjected to T6 treatment and FIG. 6B shows an example where an aluminum alloy of the present invention containing a neutralizing casting defect element is subjected to T6 treatment;

FIG. 7 shows the state of distribution of Mg and Cu alloy ingredients resulting from the addition of a neutralizing casting defect element obtained by EPMA observation, wherein

FIGS. 11A and 11B are a photograph of a fracture surface of a starting point of destruction according to a fatigue test, wherein FIG. 11A shows a comparative example and FIG. 11B shows the example of the present invention;

DESCRIPTION OF THE PREFERRED EMBODIMENTS

Preferred embodiments of the present invention will be described in detail below while referring to the attached figures.

Figure 3A:
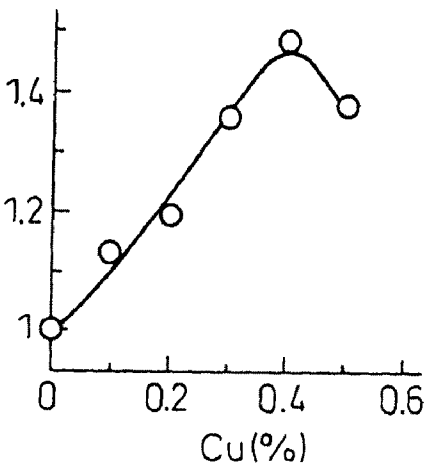
Figure 3B:
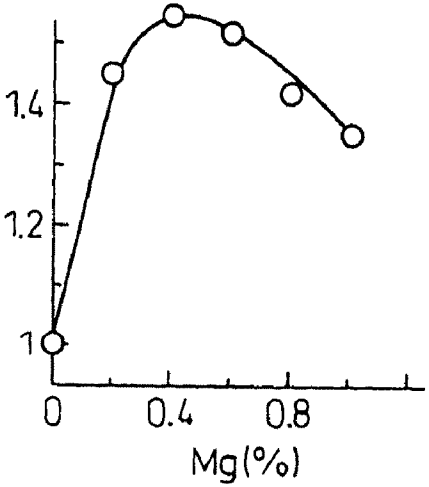
Figure 3C:
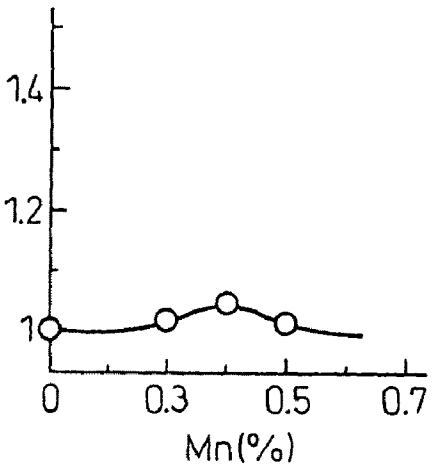

To increase the strength of an aluminum alloy casting, the first high strength aluminum alloy casting of the present invention is an alloy casting comprised of an aluminum alloy comprised of 7.5 to 11.5 wt % of Si, 3.8 to 4.8 wt % of Cu, 0.45 to 0.65 wt % of Mg, 0.4 to 0.7 wt % of Fe, 0.35 to 0.45 wt % of Mn, and the balance of Al and not more than 0.2 wt % of unavoidable impurities to which 0.1 to 0.3 wt % of Ag is added. First, in the present invention, by adjusting the amounts of Cu, Mg, and Mn as shown in FIGS. 3A to 3C to improve the strength and adding a slight amount of Ag to the aluminum alloy of the above basic composition, the compounds of the precipitation hardening elements included in the alloy, that is, Cu, Mg, and Si, more finely disperse in the alloy and precipitate, so it is possible to improve the strength of the aluminum alloy casting by the fine precipitation of these precipitates. Further, second, by adding a slight amount of Ag to the aluminum alloy of the above basic composition, the needle Fe casting structure which causes a reduction in strength if becoming coarser in the alloy is made finer, so the drop in strength of the aluminum alloy casting can be suppressed. Further, third, by adding a slight amount of Ag to the aluminum alloy of the above basic composition, it is possible to improve the strength of the aluminum alloy casting.

Note that in the present invention, if the content of Ag is less than 0.1 wt %, its contribution to the increased fineness of the eutectic Si structure, the increased fineness of the needle Fe structure, and the increased uniformity and fineness of the precipitation hardening alloys of Cu, Mg, and Si is too small. Further, if the content of Ag is over 0.3 wt %, the contribution to the increased fineness of the eutectic Si structure, the increased fineness of the needle Fe structure, and the increased uniformity and fineness of the precipitation hardening alloys of Cu, Mg, and Si disappears almost completely. Therefore, in the present invention, the amount of the Ag added to the aluminum alloy is limited to the range of 0.1 to 0.3 wt %. Further, the unavoidable impurities are preferably not more than 0.2 wt %.

Further, in the present invention, the amount of gas included in the aluminum alloy casting of the present invention is kept to not more than 1.5 $cm^3$, preferably not more than 0.5 $cm^3$, with respect to 100 g of high strength aluminum alloy and solubilization and age hardening performed. By defining the amount of gas in the aluminum alloy casting, even if performing the next explained high temperature, long solubilization and age hardening, there will never be an instance where entrained gas expands and causes blisters which cause a drop in strength of the high strength aluminum alloy casting.

Further, to increase the strength of the aluminum alloy casting, the above object, the high strength aluminum alloy casting of the present invention is solubilized by heating in a temperature range of 495 to 505° C. for 2 to 6 hours, then quenched and further then age hardened by heating in a temperature range of 160 to 220° C. for 2 to 6 hours. By solubilizing the high strength aluminum alloy casting die cast according to the present invention under the above conditions, compounds of the precipitation hardening elements included in the alloy, that is, Cu, Mg, and Si, precipitate dispersed finely and uniformly in the alloy together with the Ag of the slight amount of the additive element, so the precipitation hardening of the aluminum alloy casting is improved. Further, in the present invention, by quenching after solubilization and then age hardening, the eutectic Si structure made finer by the Ag of the additive element in the alloy is granularized, so the aluminum alloy casting is further strengthened. As the above quenching, in addition to water quenching, oil quenching, oil and water emulsion quenching, etc. are employed.

Note that in the high strength aluminum alloy casting of the present invention, if the amount of gas included in this high strength aluminum alloy casting exceeds 1.5 $cm^3$ with respect to 100 g of the alloy casting, blistering occurs in the casting and the casting is deformed during solubilization at about 500° C. for 6 hours. Therefore, the amount of gas included in the high strength aluminum alloy casting of the present invention is made not more than 1.5 $cm^3$ with respect to 100 g of the alloy casting. Further, by reducing the pressure in the mold of the die cast machine to not more than 13.3 kPa or then blowing oxygen of a pressure of at least atmospheric pressure into the mold, it is possible to keep the amount of gas included in the aluminum alloy casting not more than 1.5 $cm^3$ with respect to 100 g of high strength aluminum alloy. Further, it is also possible to suppress this in the method of closing mold halves, pouring aluminum melt into a melt sleeve of a die, cast machine, then slowly advancing an injection plunger so as to prevent air, heat decomposition gas generated from the release agent, lubricant, etc. in the cavity from being entrained while filling a high strength aluminum alloy in the mold.

The solubilized and age hardened high strength aluminum alloy casting of the present invention has eutectic Si of a particle size of an average not more than 12 μm, a Cu compound of a particle size of not more than an average 8 μm, an Mg—Si compound of a particle size of not more than an average 12 μm, and an Fe compound of a particle size of not more than an average 6 μm. By giving the high strength aluminum alloy casting including Ag of the present invention the above particle size by the above solubilization and age hardening, it was possible to improve the tensile strength, yield strength, and fatigue strength by about 5 to 10% compared with a conventional aluminum alloy casting not including Ag, but having alloy ingredients equivalent to the present invention.

The second high strength aluminum alloy casting of the present invention achieves an improvement in the strength and a reduction of the variation in strength of the aluminum alloy casting by reducing the casting defects of the cast or die cast aluminum alloy casting, making the structure more uniform and making the structure more finely dispersed, and adding suitable amounts of Cu and Mg.

As the method of reducing the casting defects of the aluminum alloy casting, there are 1) the method of evacuation of the air and gas of the release agent etc. in the cavity for suppressing entrainment defects and filling the aluminum alloy melt in the cavity at a low speed and 2) local pressurization for suppressing sink marks. These defect preventing techniques, however, are problematic in that the casting technology is difficult. It is difficult to suppress defects by just the casting technology. To prevent such defects, the solution is to add to the casting material:

(1) a slight amount of a rare earth element able to form a compound with the hydrogen forming the cavity defects and (2) a slight amount of a rare earth element for dispersing the gas and suppressing the apparent defect dimensions by increasing the fineness of dispersion of the slowly solidifying eutectic Si by the rare earth element, that is, increasing the fineness of the eutectic Si parts where gas ingredients easily accumulated in the process of solidification.

Further, as the method of strengthening the aluminum alloy, there is the method of increasing the uniformity of structure and increasing the fineness of dispersion of structure of the aluminum alloy casting. As prior art, there is addition of ingredients such as Ti, Ca, Zr, Na, Sr, etc. These methods are aimed at increasing the fineness of the eutectic crystal and a crystal. Further, for strengthening the alloy, it is necessary to add suitable amounts of the precipitation hardening ingredients Cu and Mg, but it is difficult to cause the Cu and Mg to uniformly disperse in the casting. If adding at least a certain amount of Cu, there is the detrimental effect that the casting will easily crack during casting. To deal with this problem, by adding a rare earth element, it is possible to increase the fineness of dispersion of Cu and Mg and increase the strength more at the structure surface. Further, it is known that it is possible to form clumps in the needle structure of the strength inhibiting element Fe by adding a certain percentage of Mn, but if it were possible to increase the uniformity and increase the fineness of the distribution, the Fe would not locally accumulate and become harmful. A rare earth element is also effective for this problem.

By adding slight amounts of rare earth elements able to form hydride compounds with molten hydrogen and neutralizing casting defect elements comprised of a second group of additive elements of Rb, K, Ba, Sr, Zr, Nb, Ta, V, and Pd, when casting or die casting aluminum alloy, the casting defects of the aluminum alloy casting are reduced, increased uniformity of structure and increased fineness of dispersion are achieved, and the strength of the aluminum alloy casting is strikingly improved.

To solve the above problem, the high strength aluminum alloy casting of the present invention contains 0.1 to 1.0 wt % of at least one type of a neutralizing casting defect element (NCDE) of the group of second additive elements of Rb, K, Ba, Sr, Zr, Nb, Ta, V, and Pd and rare earth elements. During casting or die casting, the neutralizing casting defect element (NCDE) suppresses the casting defects arising due to the molten hydrogen by forming a hydride with the molten hydrogen in the aluminum alloy. The aluminum alloy of the present invention contains 7.5 to 11.5 wt % of Si, 3.8 to 4.8 wt % of Cu, 0.45 to 0.65 wt % of Mg, 0.4 to 0.7 wt % of Fe, 0.35 to 0.45 wt % of Mn, not more than 0.2 wt % of unavoidable impurities, and the balance of Al. The amount of gas included in the high strength aluminum alloy casting of the present invention is suppressed to the range of 0.5 to 1.5 $cm^3$ with respect to 100 g of high strength aluminum alloy casting and solubilization and age hardening are applied to improve the strength. Further, the high strength aluminum alloy casting of the present invention is solubilized by heating in a temperature range of 495 to 505° C. for 2 to 6 hours, then quenched and further then age hardened by heating in a temperature range of 160 to 220° C. for 2 to 6 hours. The solubilized and age hardened high strength aluminum alloy casting of the present invention has eutectic Si of a particle size of an average not more than 12 μm, a Cu compound of a particle size of not more than an average 8 μm, an Mg—Si compound of a particle size of not more than an average 12 μm, and an Fe compound of a particle size of not more than an average 6 μm.

Figure 4B:
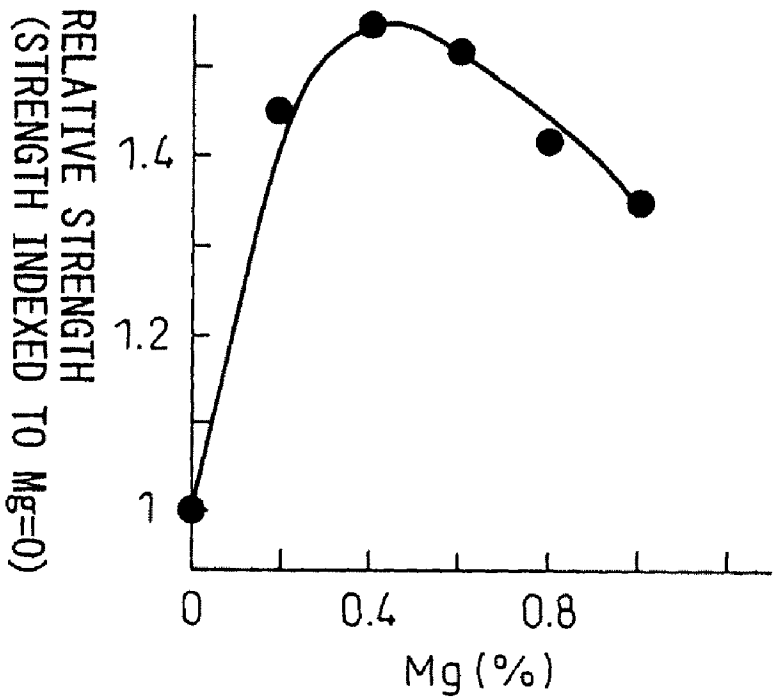
Figure 4A:
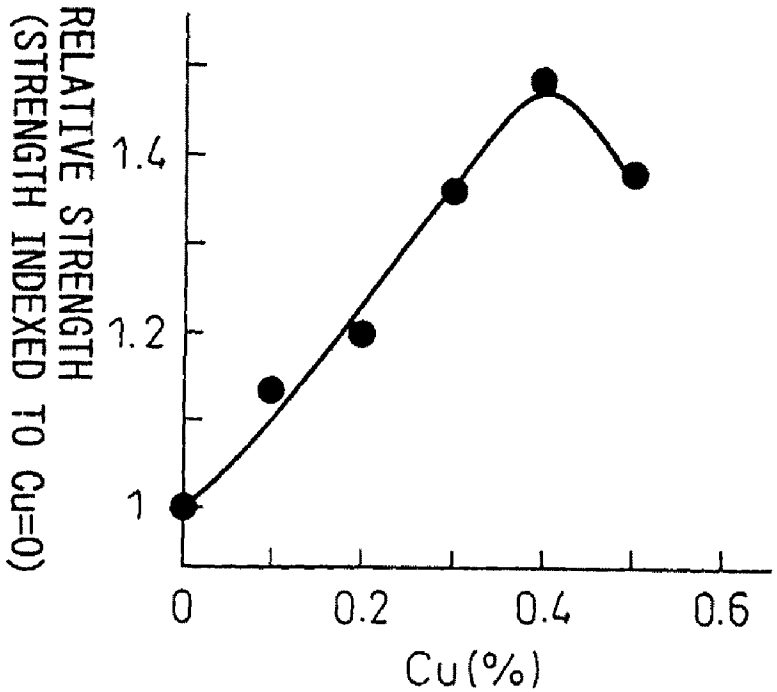

As shown in FIGS. 4A and 4B, the content of Mg is extremely influential on the strength. If too large or too small, the strength drops. To achieve higher strength, further, the Cu is limited to 3.8 to 4.8 wt % and the Mg to 0.45 to 0.65 wt %.

To solve the above problem, the method of production of a high strength aluminum alloy casting of the present invention comprises the steps of solubilizing a high strength aluminum alloy casting by heating in a temperature range of 495 to 505° C. for 2 to 6 hours, water quenching the high strength aluminum alloy casting after the solubilization, and age hardening the high strength aluminum alloy casting by heating in a temperature range of 160 to 220° C. for 2 to 6 hours after the water quenching.

Further, a scroll for a compressor of an air-conditioner of the present invention is made from this high strength aluminum alloy casting. The method of production of a scroll for a compressor of an air-conditioner comprises the steps of reducing the pressure inside the mold to not more than 13.3 kPa and filling the mold with high strength aluminum alloy after reduction of pressure for die casting or the step of closing mold halves, pouring aluminum melt into a melt sleeve of a die cast machine, then filling high strength aluminum alloy into the mold while advancing an injection plunger at a low speed so as to keep air, heat decomposition gas produced from a release agent, etc. from being entrained. Further, the method of production of the scroll comprises the steps of reducing the pressure in the mold to not more than 13.3 kPa, adjusting the atmosphere by blowing in oxygen of a pressure of at least atmospheric pressure, and filling a high strength aluminum alloy in the mold after adjusting the pressure.

Figure 5:
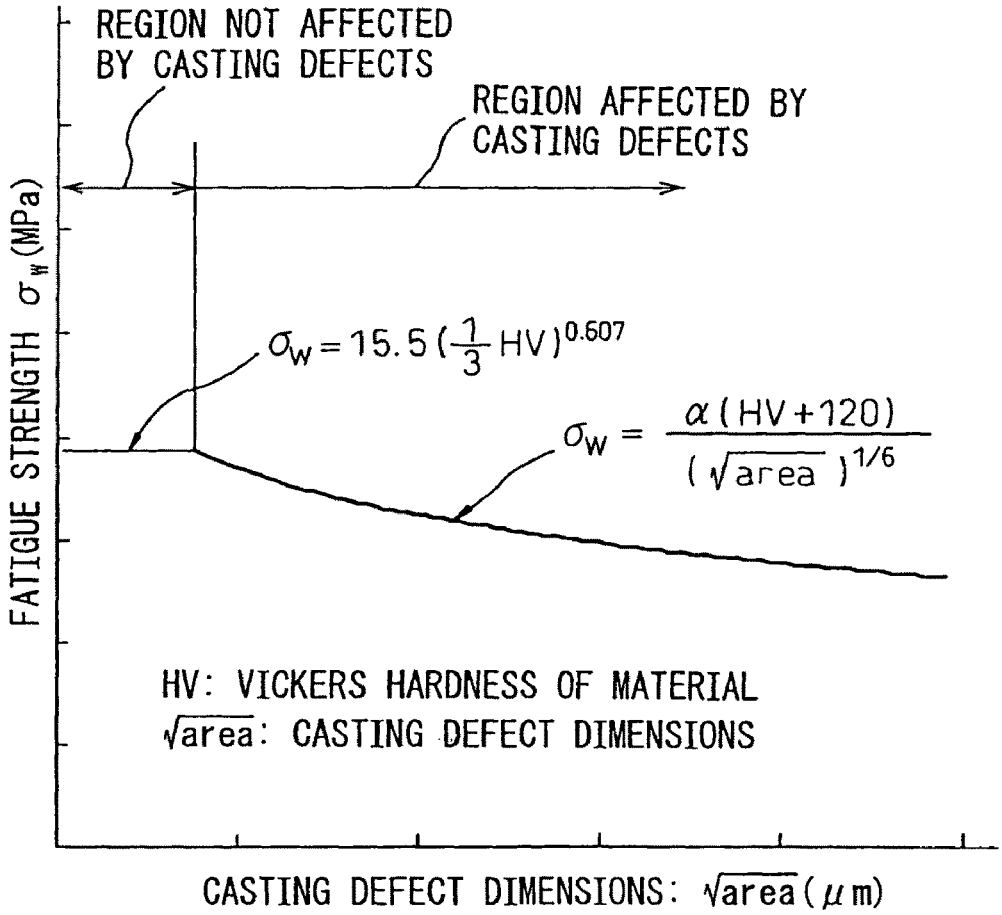
FIG. 5 shows the relationship between the dimensions of casting defects and the fatigue strength.

As shown in FIG. 5, in the region where the casting defect dimensions, which have a strong correlation with the amount of gas, are small, the strength is sensitive, while below the limit casting defect dimension, the strength is not affected by a casting defect. In the present invention, by adding a rare earth element to a die casting material with an amount of gas kept to less than 1.5 $cm^3$/100 g Al, it is possible to make the casting defect dimensions small enough so as not to affect the strength. As a result, an improvement in strength and reduction of variation in strength are achieved.

Turning now to specific examples, the aluminum alloy of the present invention prepared for improving the strength of the alloy casting has a basic chemical composition of 10.5 wt % of Si, 4.5 wt % of Cu, 0.6 wt % of Mg, 0.5 wt % of Fe, 0.4 wt % of Mn, unavoidable impurities, and a balance of Al and, also, 0.2 wt % of Ag. As an aluminum alloy of a comparative example, the basic composition with no Ag was prepared.

Figure 1:
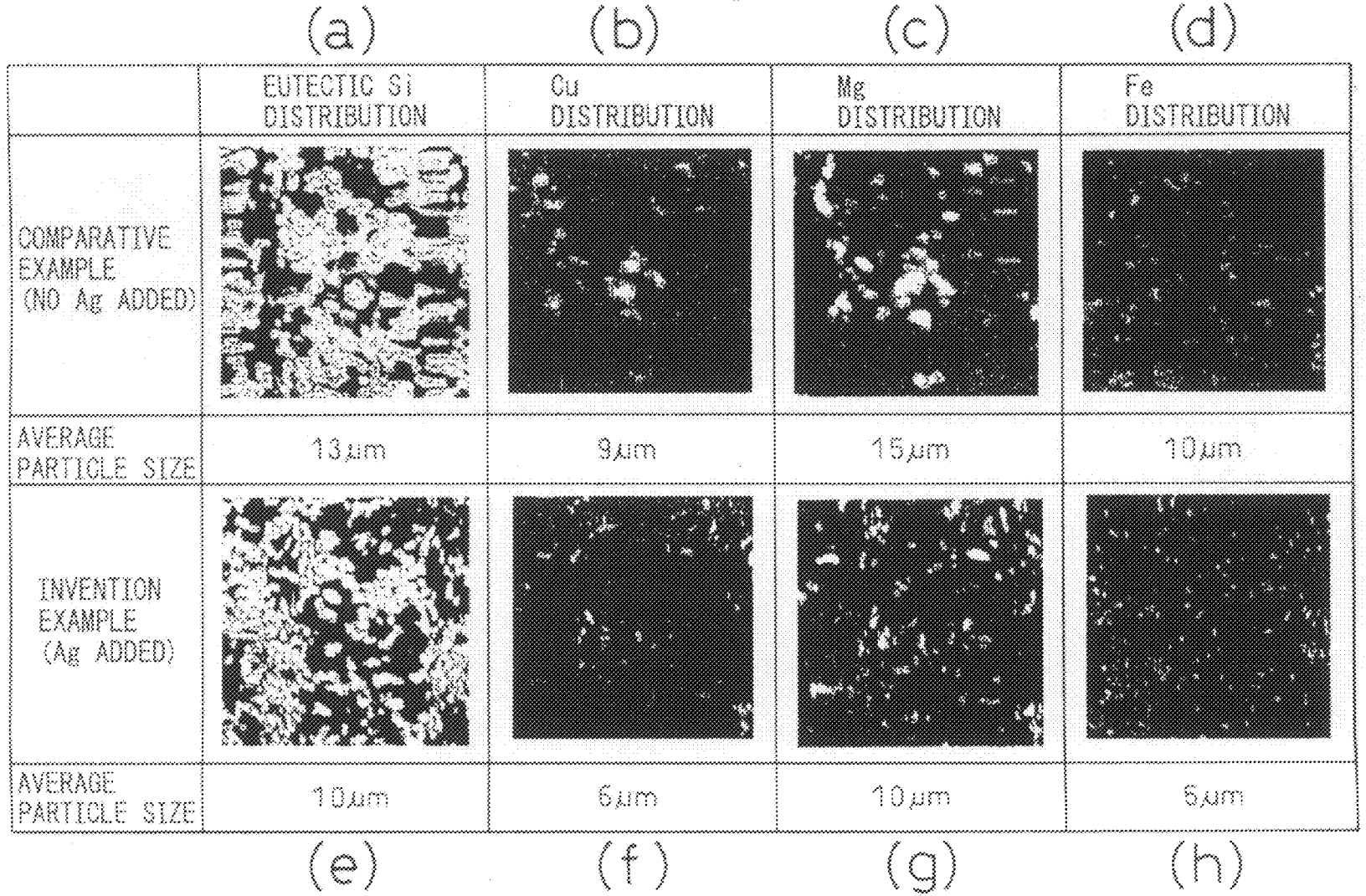
FIG. 1 is a view of the state of distribution of alloy ingredients by EPMA observation for an aluminum alloy to which Ag is added of the present invention and an alloy to which Ag is not added of a comparative example.

These alloys were die cast by a conventional die cast machine. The states of distribution of the alloy ingredients were observed by EPMA. FIG. 1 shows the state of distribution of alloy ingredients by observation by EPMA for the aluminum alloy to which Ag is added of the present invention and the alloy to which Ag is not added of the comparative example.

In "a" of FIG. 1, the distribution of eutectic Si of the sample with no Ag added of the comparative example showed relatively coarse eutectic Si. On the other hand, in "e" of FIG. 1, the eutectic Si distribution of the Ag-containing sample of the present invention shows eutectic Si increased in fineness. Further, in "b", "c", and "d" of FIG. 1, the distributions of the Cu compound, Mg—Si compound, and Fe compound of the sample with no Ag added of the comparative example show local distribution of relatively coarse particles. In particular, since the precipitation hardening alloys of the Cu compound and Mg—Si compound become coarser and locally distributed, they cause a drop and variation in strength. In particular, if the amount of Cu is increased too much, the problem of cracking during casting occurs, but by making the distribution of the Cu compound more uniform, the problem of cracking will not easily arise even if making the content of Cu relatively higher. Further, the distribution of the Fe compounds shows a relatively long needle structure. On the other hand, in "f", "g", and "h" of FIG. 1, the distributions of the Cu compound, Mg—Si compound, and Fe compound of the Ag-containing sample of the present invention tend to be uniform distributions of fine particles. Since the precipitation hardening elements Cu and Mg are increased in fineness and uniformly distributed, it is possible to increase the strength and reduce the variation in strength. Further, the distribution of Fe did not cause almost any harmful needle structures due to the synergistic effect of the increased clumping due to addition of Mn and the dispersal of Fe caused due to the addition of Ag.

EXAMPLE 1

An alloy containing 10.5 wt % of Si, 4.5 wt % of Cu, 0.6 wt % of Mg, 0.5 wt % of Fe, 0.4 wt % of Mn, unavoidable impurities, and the balance of Al and further containing 0.2 wt % of Ag was prepared.

A melt of the aluminum alloy was die cast into a scroll for a compressor of an air-conditioner using a conventional die cast machine. After release from the mold, the casting of the scroll of the aluminum alloy was solubilized by heating in a temperature range of 495 to 505° C. for 2 to 6 hours. The solubilized casting of the scroll was then water quenched in the present example. After water quenching, the casting of the scroll was age hardened by heating in a temperature range of 160 to 220° C. for 2 to 6 hours. The casting of the scroll for a compressor of an air-conditioner obtained could be increased in tensile strength, yield strength, and fatigue strength by about 5 to 15%.

EXAMPLE 2

In this embodiment, first the inside of the mold of a die cast machine was reduced in pressure to not more than 13.3 kPa (100 Torr) using a vacuum pump. The casting of the scroll of the aluminum alloy taken out from the mold, like in Example 1, was solubilized by heating in a temperature range of 495 to 505° C. for 2 to 6 hours and then, in the present example, water quenched and age hardened by heating in a temperature range of 160 to 220° C. for 2 to 6 hours. Even if subjecting the casting of the scroll for a compressor of an air-conditioner obtained to the above high temperature, long solubilization and age hardening, the entrainment of gas was suppressed by evacuating the inside of the mold at the time of die casting, so there was less blistering and no problem of a drop in strength.

EXAMPLE 3

In this example, in the same way as in Example 2, the atmosphere was adjusted by reducing the pressure inside of the mold of the die cast machine to not more than 13.3 kPa (100 Torr) using a vacuum pump, then blowing oxygen of at least atmospheric pressure into the mold. The melt of aluminum alloy shown in Example 1 was filled in the mold to die cast a scroll for a compressor of an air-conditioner. The casting of the scroll of an aluminum alloy taken out from the mold, like in Example 1, was solubilized by heating in a temperature range of 495 to 505° C. for 2 to 6 hours and then, in the present example, water quenched and age hardened by heating in a temperature range of 160 to 220° C. for 2 to 6 hours. Even if subjecting the casting of the scroll for a compressor of an air-conditioner obtained to the above high temperature, long solubilization and age hardening, the entrainment of gas was suppressed by evacuating the inside of the mold and blowing in oxygen at the time of die casting, so there was less blistering and the problem of the drop in strength did not occur.

The cause of occurrence of first casting defects is the bubbles caused by entrainment of the gas in the cavity in the melt when filling an aluminum alloy melt in a cavity of a mold of a die cast machine at a high speed and high pressure, that is, these are casting defects caused by gas in the cavity. The cause of occurrence of second casting defects is the moisture in the mold (casting mold) and the moisture of the release agent etc. reacting with the melt of the aluminum alloy to produce hydrogen in the melt which then becomes included in the product as bubbles during the process of solidification. That is, these are casting defects caused by molten hydrogen produced in the melt during filling.

The casting defects occurred, in particular the cavity defects occurred, include entrainment cavities due to entrainment of air and heat decomposition gases produced from the release agent etc. and sink marks arising in the process of solidification of aluminum or another light metal in a mold. The approach to reducing the first casting defects caused by the gas in the cavity is generally improvement of the casting method. However, reduction of the casting defects by improvement of the casting method not only invites a rise in price of the die casting, but also requires limitations in the shape of the product. Further, there are limits to the size of the casting defects which can be reduced by improvement of the casting method. At the present, it is almost impossible to eliminate casting defects of a size of less than 100 μm. As methods for reduction of casting defects of an aluminum alloy casting, there are, at the time of casting, 1) the method of evacuating the air, gas of the release agent, etc. in the cavity for suppressing entrainment cavities and filling the aluminum alloy melt into the cavity at a low speed and 2) the method of local pressurization for suppressing sink marks. These techniques for preventing defects, however, suffer from the problem of difficulty in the casting technology. It is difficult to suppress defects by just casting technology. To prevent such defects, (1) a slight amount of a rare earth element able to form a compound with the hydrogen forming the cavity defects is added and (2) the slowly solidifying eutectic Si is increased in fineness of dispersion by the rare earth element leading to increased fineness of the eutectic Si part where gas ingredients easily gather in the process of solidification, whereby the gas is dispersed and the apparent defect dimensions are kept down.

Observation of Structure

First, the results of observation of the structures of a high strength aluminum alloy casting of an example of the present invention containing a neutralizing casting defect element and subjected to T6 treatment (shown by FIG. 6B) and alloy casting of a comparative example not containing a neutralizing casting defect element and subjected to T6 treatment (shown by FIG. 6A) will be shown.

Figure 6A:
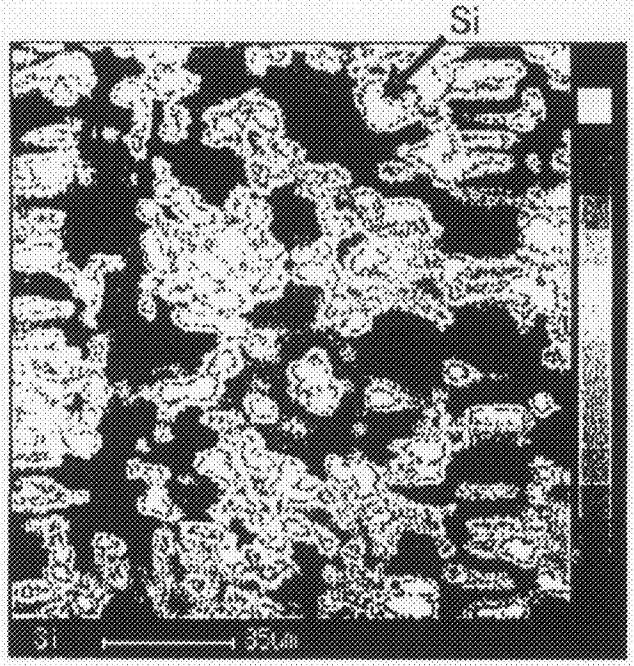
Figure 6B:
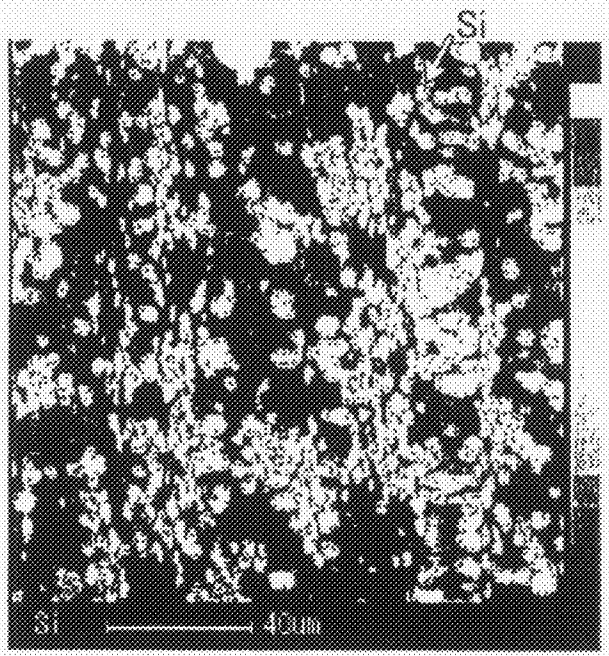

The aluminum alloys of the example of the present invention and a comparative example contain 9.5 to 11.5 wt % of Si, 3.8 to 4.8 wt % of Cu, 0.45 to 0.65 wt % of Mg, 0.4 to 0.7 wt % of Fe, 0.35 to 0.45 wt % of Mn, not more than 0.2 wt % of unavoidable impurities, and the balance of Al. Further, the high strength aluminum alloy of the present invention contains 0.1 to 1.0 wt % of at least one type of neutralizing casting defect element selected from the group of Rb, K, Ba, Sr, Zr, Nb, Ta, V, Pd, La, and Ce. To study the increased dispersion and increased fineness of eutectic Si in the aluminum alloy of the example of the present invention and comparative example, the structures were examined by EPMA. FIG. 6 shows the EPMA observed structures of aluminum alloys of the example of the present invention and comparative example subjected to T6 treatment. FIG. 6A shows a comparative example of the above aluminum alloy subjected to only T6 treatment. Eutectic Si of a relatively coarse needle structure was observed. FIG. 6B shows an example of an aluminum alloy of the present invention containing a neutralizing casting defect element subjected to T6 treatment. Eutectic Si free of any needle structure, increased in fineness, and increased in dispersion was observed. From the results, in the example of an aluminum alloy to which a neutralizing casting defect element is added and subjected to T6 treatment of the present invention, it was observed that there was an effect of increased fineness and increased dispersion on the alloy ingredients of Cu, Mg, Mn, and Fe.

Figure 7A:
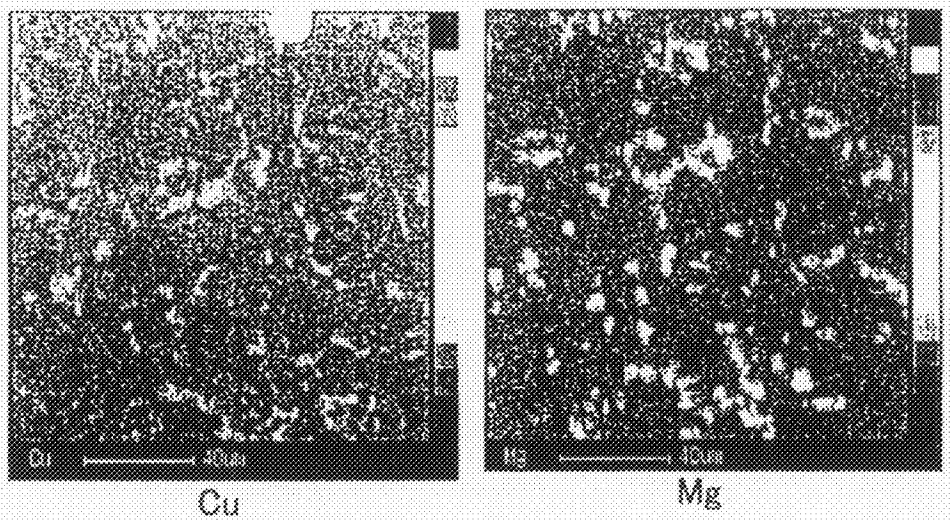
FIG. 7A shows the example of the present invention and FIG. 7B shows a comparative examples.
Figure 7B:
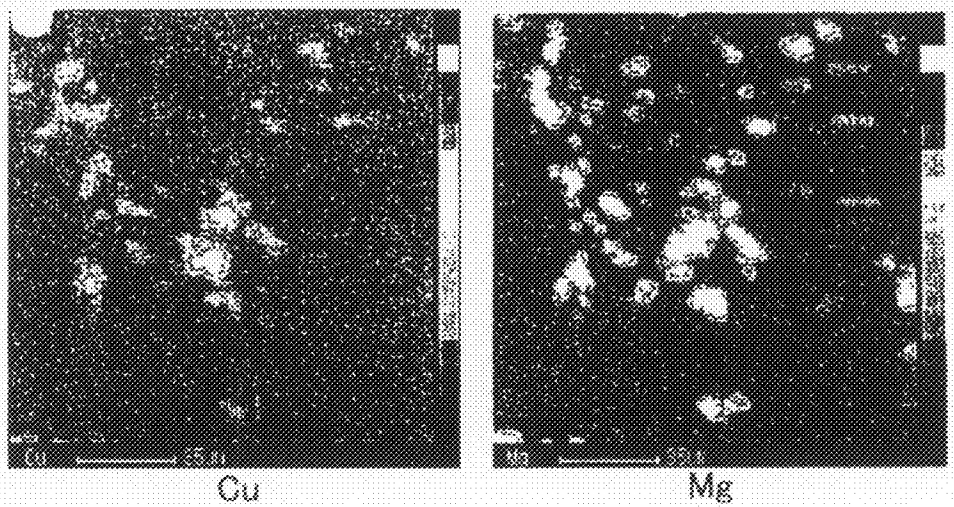

Due to the increased fineness and increased dispersion due to these alloy ingredients, the addition of a neutralizing casting defect element enables an improvement of strength and reduction of variation in strength of an aluminum alloy casting. FIGS. 7A and 7B shows the results of observation of the state of distribution of the Mg and Cu alloy ingredients due to the addition or absence of a neutralizing casting defect element using EPMA. In the embodiments where a neutralizing casting defect element was added, both with the alloy ingredients of Mg and Cu, increased fineness and increased dispersion were exhibited compared with the comparative example (FIG. 7A) not including any neutralizing casting defect element.

Next, to more clearly confirm the production of a hydride by a neutralizing casting defect element, time-of-flight secondary ion mass spectrometry (TOF-SIMS) was used to try to detect any hydride (HGE-$H_3$) and aluminum hydride (HGE $(H_4Al)_3$). Further, molten gas analysis by atmospheric pressure ionization mass spectrometry (API-MS) was performed.

Neutralizing Casting Defect Elements and Hydride

Figure 8:
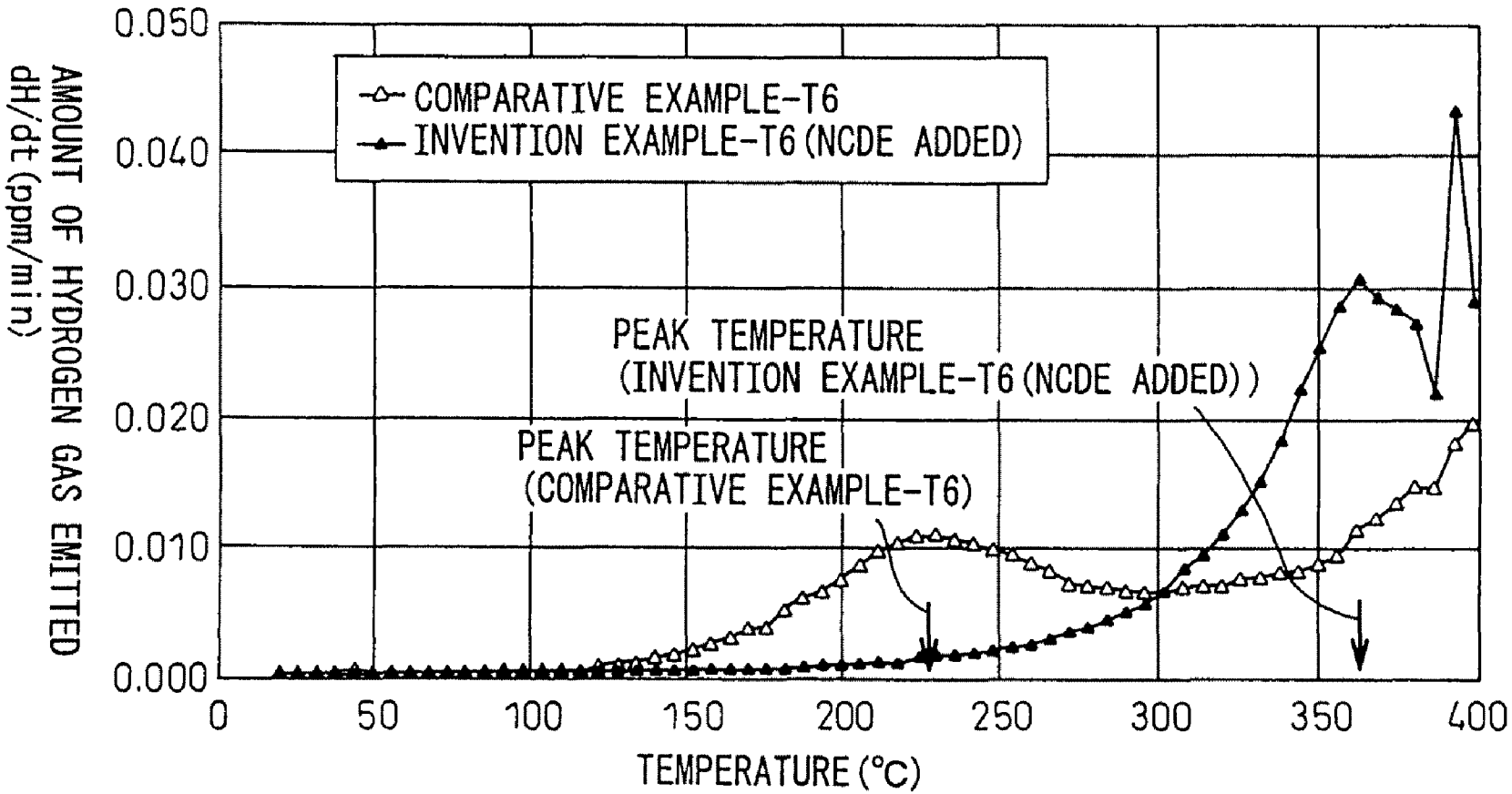
FIG. 8 shows the results of analysis of hydrogen emission by atmospheric pressure ionization mass spectrometry (API-MS)

The results of analysis of the amount of gas of a casting to which a neutralizing casting defect element is added and a casting without such addition using the Lansley method (Table 1) will be explained next. The amount of gas was 0.4 to 0.5 $cm^3$/100 g Al or no different between a casting with no addition and a casting with addition. However, when statistical processing was performed and the size of cavity defects occurring at the casting surfaces investigated, an effect of reduction of the defect dimensions was observed as shown in FIG. 8. Regarding the results, in the results of secondary ion mass spectrometry, a peak value corresponding to the neutralizing casting defect element was observed for the alloy to which the neutralizing casting defect element was added, results of mass spectrometry of the neutralizing casting defect element-$H_3$ corresponding to a hydrogen compound were obtained, and it was confirmed that the hydrogen in the aluminum was stored in the neutralizing casting defect element. Further, to confirm this, atmospheric pressure ionization mass spectrometry (API-MS) was used for hydrogen emission analysis (FIG. 8), whereupon it was found that the peak temperature for hydrogen emission was near 220° C. for a casting with no neutralizing casting defect element added, while the peak temperature shifted to about 350° C. for a casting with the neutralizing casting defect element added. From this as well, it is considered that the form by which the hydrogen causing defects is incorporated changes due to the addition of a neutralizing casting defect element.

Hydride and Molten Gas

The hydride and molten gas of a high strength aluminum alloy casting containing a neutralizing casting defect element of an example of the present invention and a casting not containing a neutralizing casting defect element of a comparative example will be shown below. The results of the total gas analysis of the aluminum alloy castings covered by the evaluation are shown in Table 1.

TABLE 1

Results of Total Gas Analysis

| Type of alloy | Hydrogen | Other gas |
|---|---|---|
| Comparative example (not containing neutralizing casting defect element) T6 | 0.40 | <0.01 |
| Invention example (containing neutralizing casting defect element) T6 | 0.50 | <0.01 |

Unit: cc/100 g

The gas included in the aluminum alloy casting was mostly hydrogen gas both in the invention example containing the neutralizing casting defect element and the comparative example not containing it. The total amounts of gas were also substantially the same. FIG. 8 shows the results of analysis of hydrogen emission by atmospheric pressure ionization mass spectrometry (API-MS). From the results of hydrogen emission of FIG. 8, the hydrogen emission peak temperature of the alloy to which the neutralizing casting defect element (NCDE) was added increased largely at the high temperature side. This is believed to indicate that the hydrogen emission peak temperature increased due to the change in the hydrogen trap sites due to the addition of the neutralizing casting defect element (NCDE). Considered together with the detection of a peak of the neutralizing casting defect element and of peaks corresponding to the neutralizing casting defect element and $H_3$ considered to be the result of trapping the hydrogen, it is believed that the hydrogen present in the melt of the aluminum alloy or generated during the filling of the melt bonds with the neutralizing casting defect element resulting in the formation of a hydride.

Casting Defects

Figure 9:
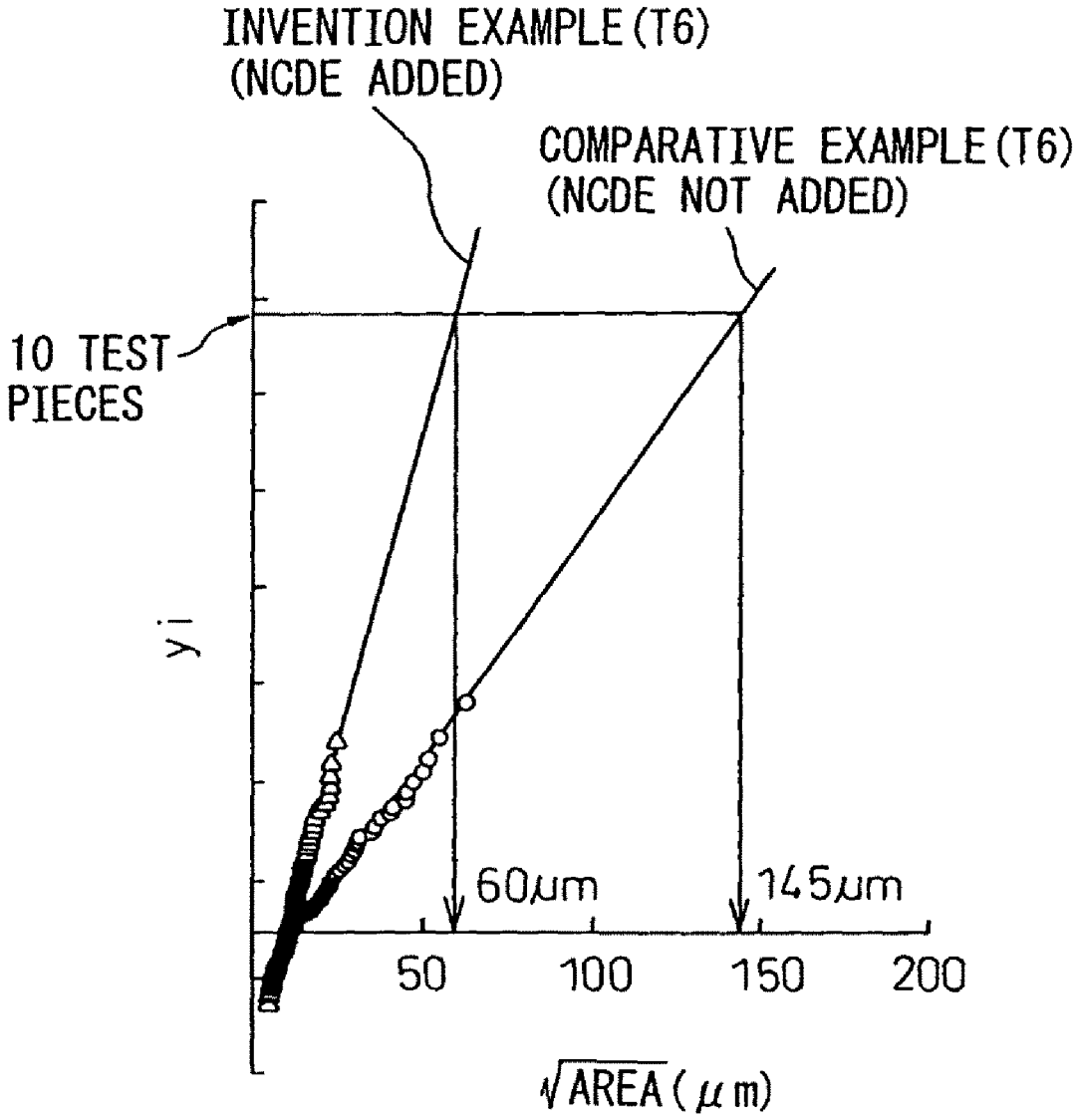
FIG. 9 shows the results of extremal value statistical processing of a total of 100 casting defects for a D10FM aluminum alloy casting containing a neutralizing casting defect element and an alloy casting not containing the same.

The size of the casting defects of a casting of the present invention containing a neutralizing casting defect element and a casting of a comparative example not containing a neutralizing casting defect element are shown below. FIG. 9 shows the results of extremal value statistical processing of a total of 100 casting defects for a casting of an invention example containing a neutralizing casting defect element and a casting of a comparative example not containing it. In FIG. 9, compared with the extremal value statistics of a casting of the comparative example to which the neutralizing casting defect element is not added, the extremal value statistic of a casting of the invention example to which the neutralizing casting defect element is added exhibited a change in the distribution of the casting defects and a reduction in the dimensions of the casting defects. The maximum defect dimension per 10 casting samples of the invention example to which the neutralizing casting defect element was added was 60 μm, while the maximum casting dimension per 10 casting samples of the comparative example to which no neutralizing casting defect element was added was 145 μm. That is, the maximum defect dimension of the casting sample of the invention example to which the neutralizing casting defect element was added was reduced to less than half the maximum defect dimension of the casting sample of the comparative example to which the neutralizing casting defect element was not added. Therefore, by adding a neutralizing casting defect element to the aluminum alloy, it was observed that the casting structure was improved and thereby the casting defects were reduced.

Fatigue Test

Figure 10:
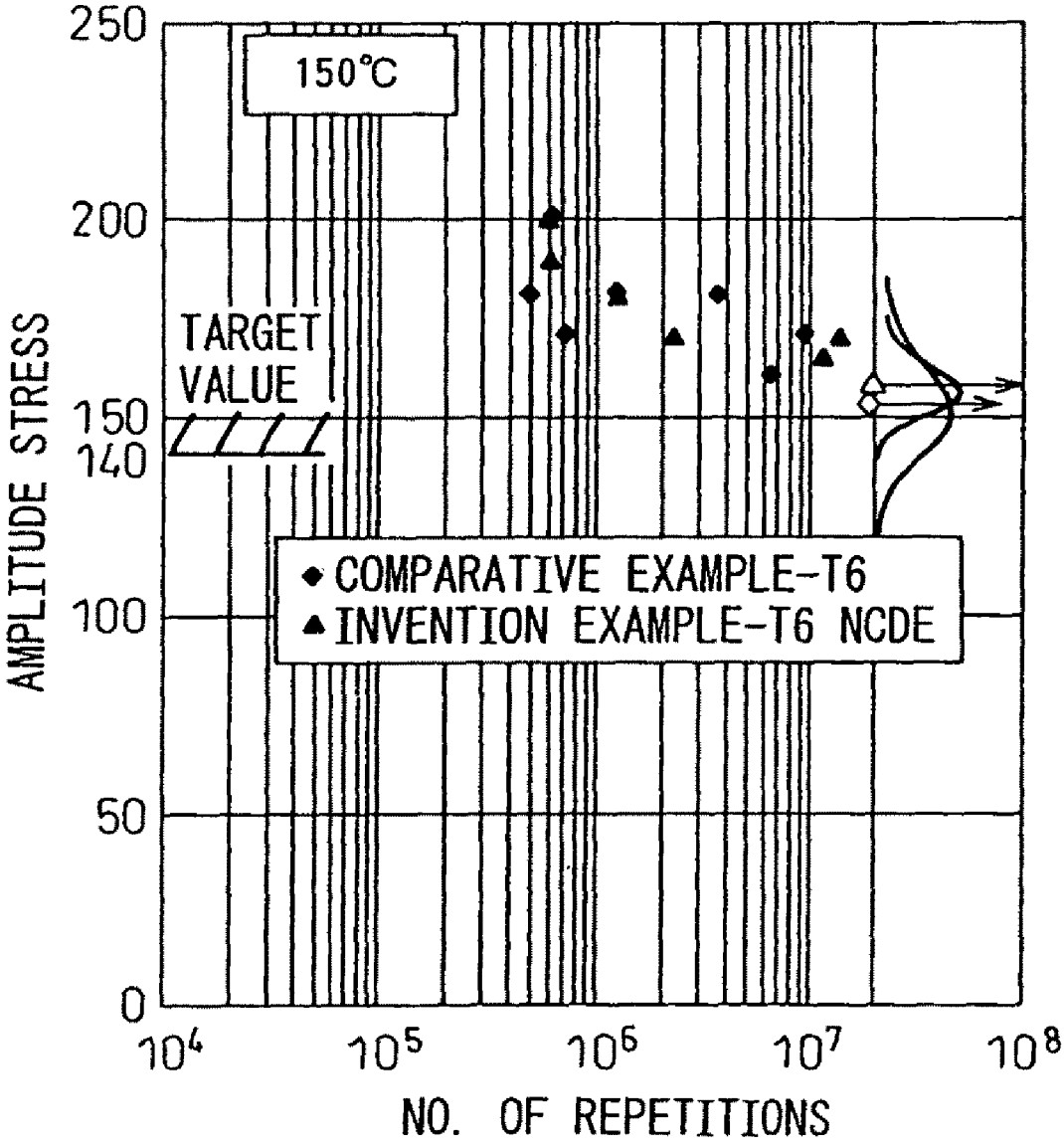
FIG. 10 shows the results of a fatigue test (S—N curve) in an environment of a temperature of 180° C. for a casting containing a neutralizing casting defect element (NCDE) and a casting not containing it.
Figure 11B:
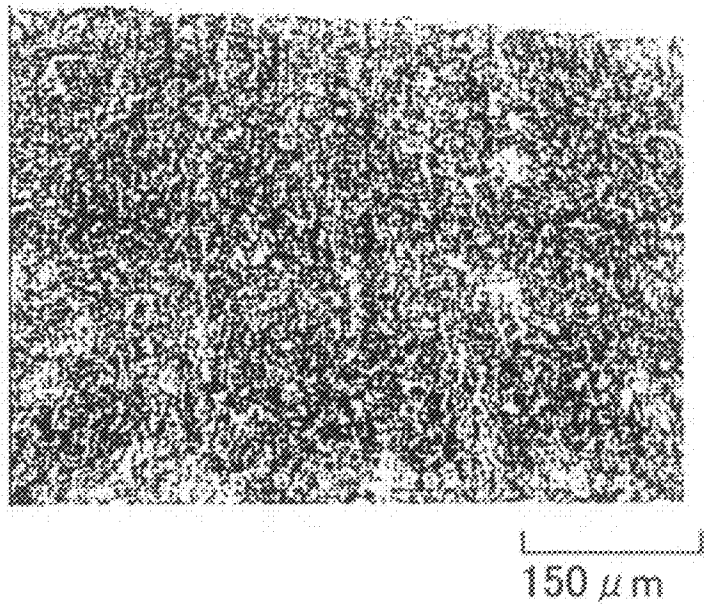
Figure 11A:
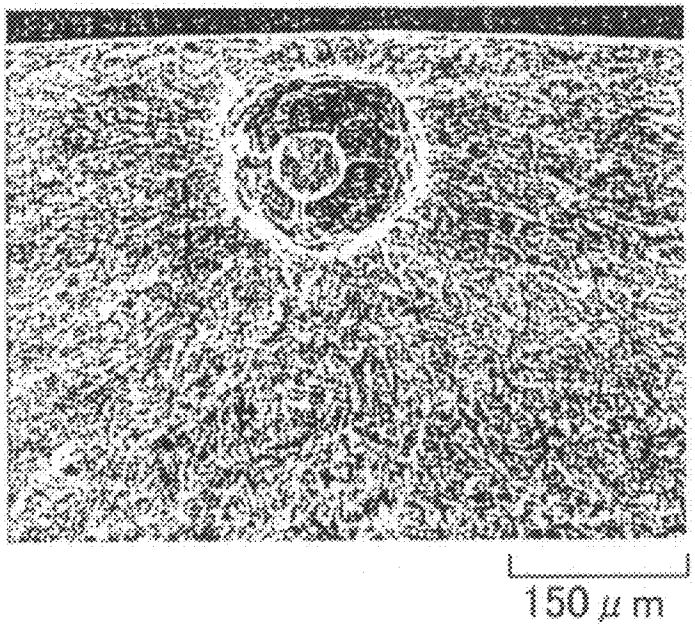

FIG. 10 shows the results of a fatigue test (S—N curve) in an environment of a temperature of 150° C. for a casting of an invention example containing a neutralizing casting defect element and a casting of a comparative example not containing it. The fatigue strength of the casting sample of the invention example to which a neutralizing casting defect element is added exhibited a reduction in the variation of the fatigue strength and an improvement in the fatigue strength compared with the fatigue strength of a casting sample of the comparative example where no neutralizing casting defect element is added. A photograph of the fracture surface of a starting point of destruction in a fatigue test is shown in FIG. 11. In all of the fracture surfaces observed, the casting sample where no neutralizing casting defect element is added has a starting point of a cavity defect of about 100 to 150 μm, while the casting sample having the neutralizing casting defect element added was destroyed from the matrix without starting from a casting defect. In the casting sample to which the neutralizing casting defect element is added, destruction occurred from the matrix due to the casting defects becoming finer across the entire matrix.

Compared with the casting sample with no element added, the casting sample to which the neutralizing casting defect element was added was improved in strength 7% and reduced in variation in strength at least 40%.

Strength Properties

Figure 12B:
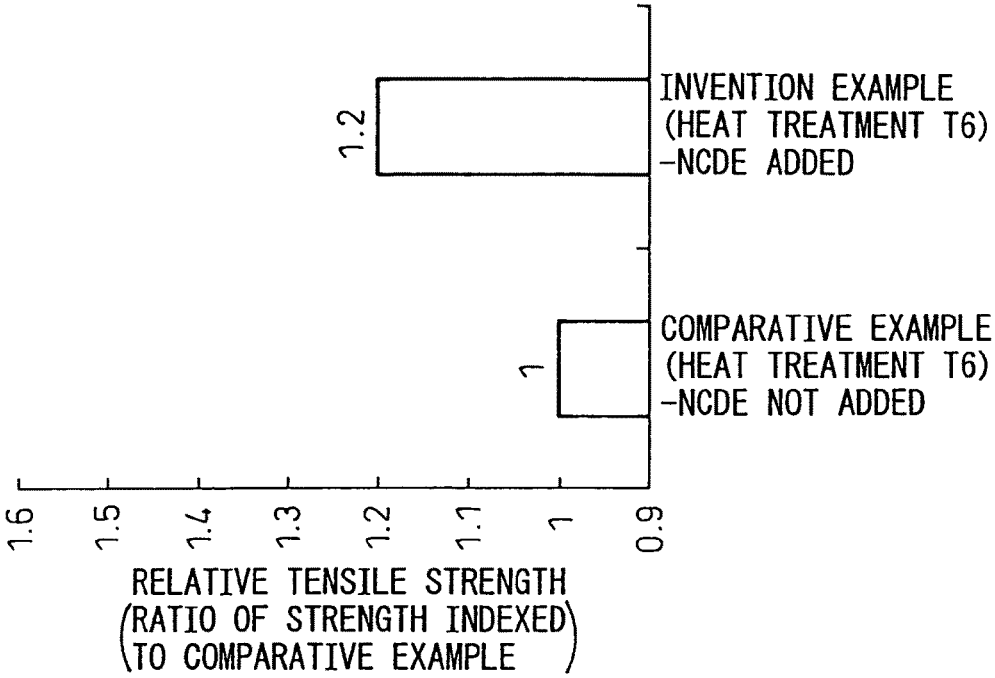
FIGS. 12A and 12B are views of a relative tensile strength (FIG. 12A) and relative fatigue strength (12B) between examples where a neutralizing casting defect element is added and comparative examples where it is not added.
Figure 12A:
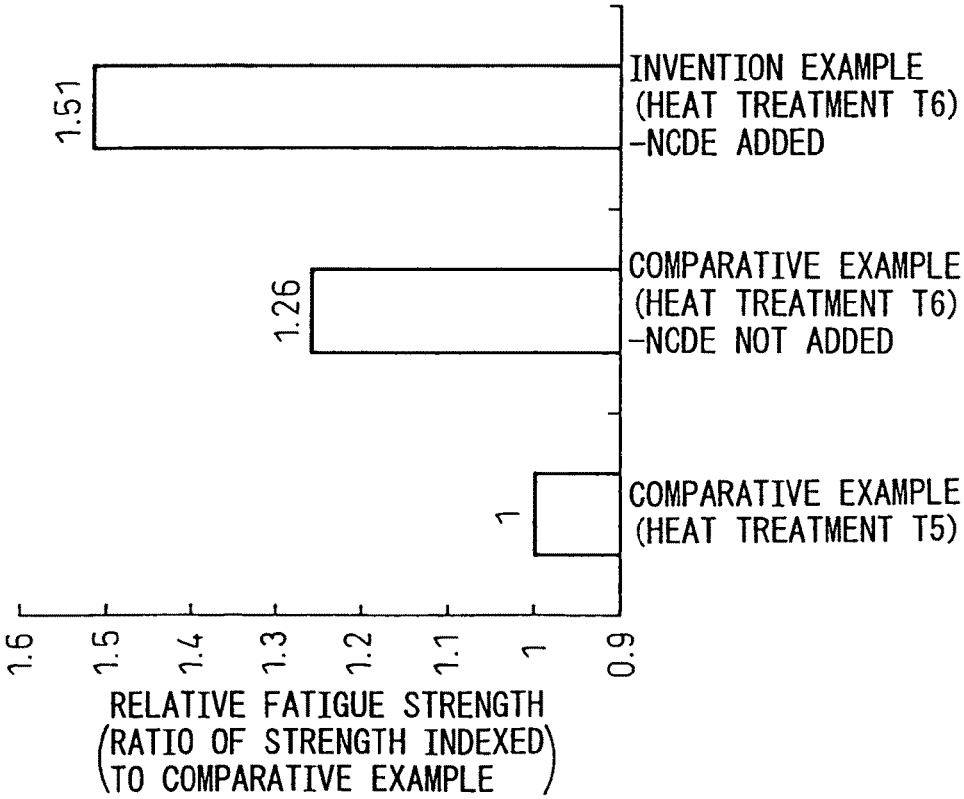

The relative tensile strength and relative fatigue strength of aluminum alloy castings of examples of the present invention where neutralizing casting defect elements are added and comparative examples are shown in FIGS. 12A and 12B. As examples of application of the material of the examples of the present invention, a scroll of a compressor of an air-conditioner such as a scroll compressor or $CO_2$ compressor, a vane rotor in a valve timing regulating device provided in a drive transmission system for transmitting drive power from a drive shaft of an internal combustion engine to a driven shaft opening and closing an intake valve or exhaust valve of an internal combustion engine, a housing of chassis parts such as an antilock braking system, etc. The relative tensile strength of an aluminum alloy casting to which a neutralizing casting defect element of the present invention is added reaches 1.51 and the relative fatigue strength reaches 1.2. The alloy casting of the present invention is provided with extremely high strength properties.

Summarizing the effects of the invention, the first alloy casting of the present invention could give a high strength aluminum alloy casting where increased fineness of the crystallization alloy elements and precipitation alloy elements are achieved by the addition of a minute amount of Ag to the aluminum alloy.

Figure 2A:
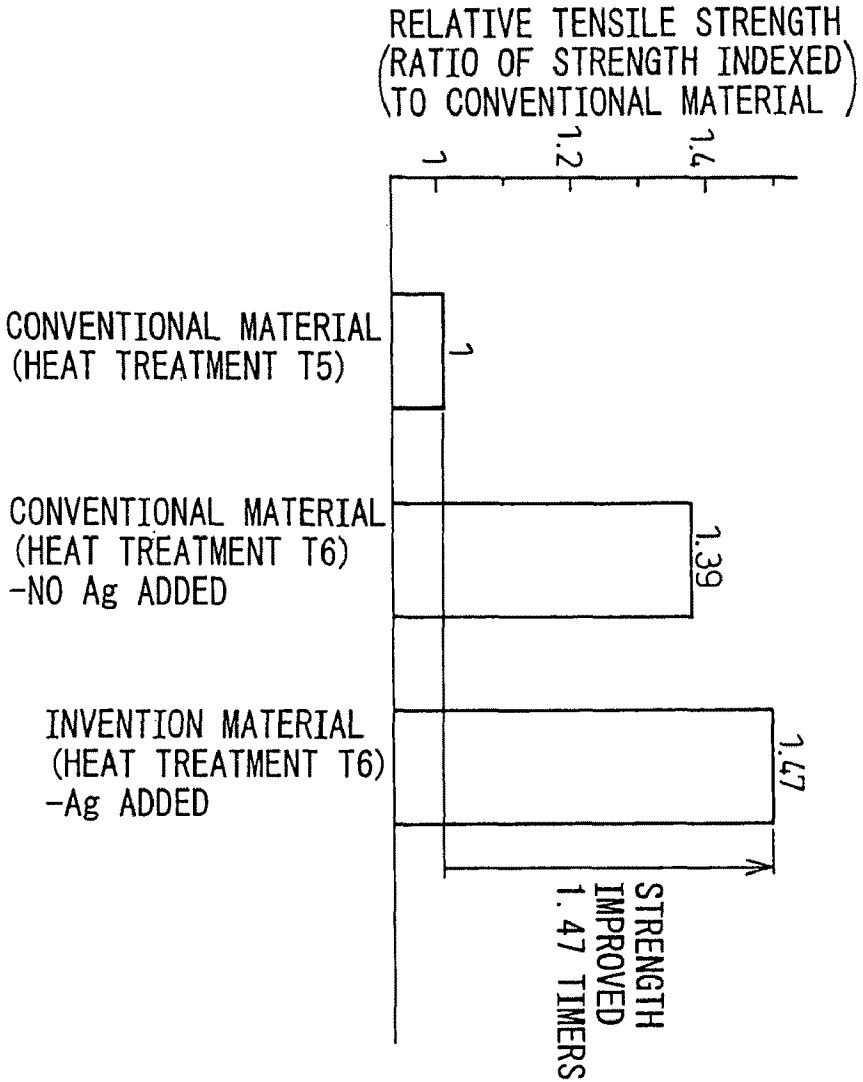
FIGS. 2A and 2B show the strengths of a high strength aluminum alloy casting of the present invention and a conventional material, where
Figure 2B:
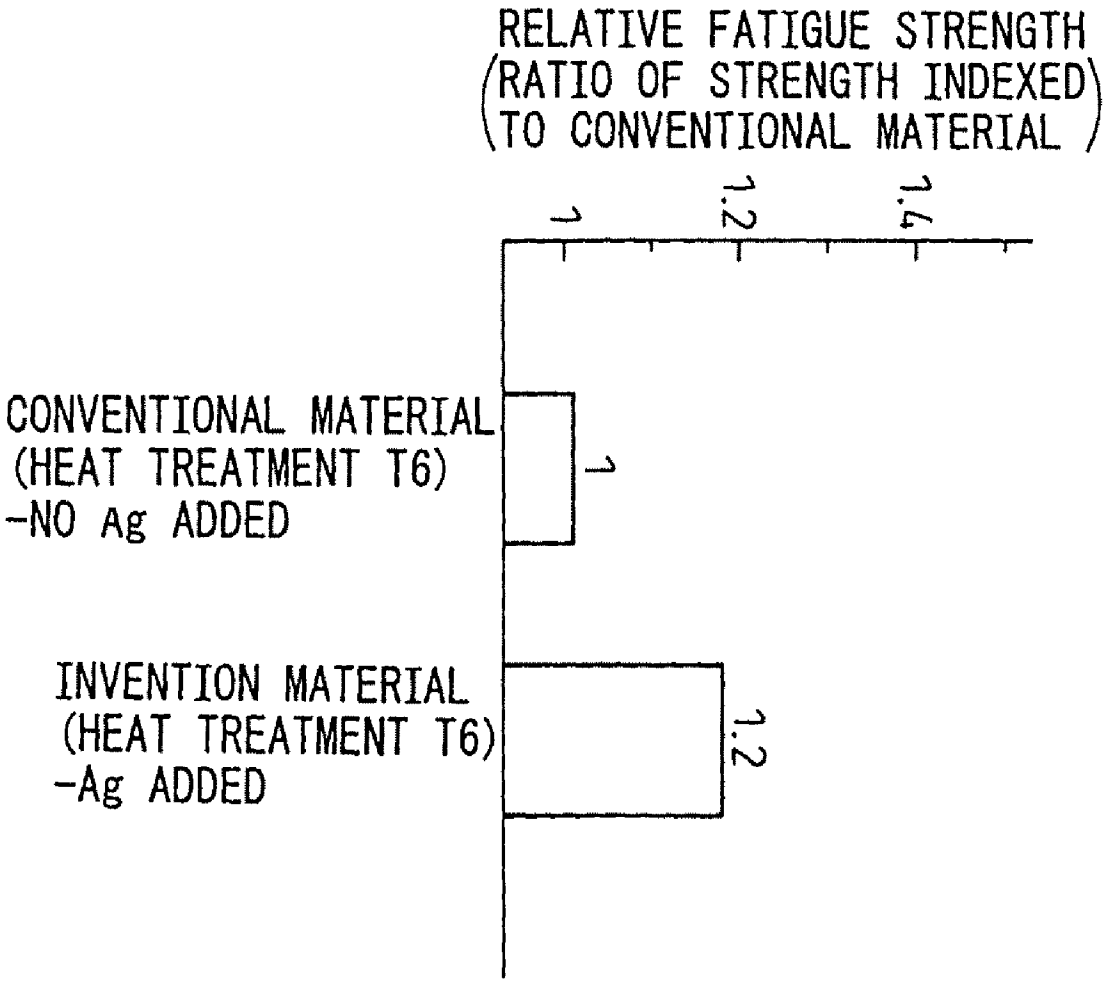

As shown in FIG. 2A, compared with a conventional material subjected to T5 heat treatment, the high strength aluminum alloy casting to which Ag is added and subjected to T6 heat treatment of the present invention features a 1.47 times greater relative tensile strength. Further, as shown in FIG. 2B, compared with a conventional material subjected to T6 heat treatment and not containing Ag, a high strength aluminum alloy casting to which Ag is added and subjected to T6 heat treatment of the present invention features 1.2 times the relative tensile and fatigue strengths.

Further, in the first alloy casting of the present invention, increased fineness and increased uniformity of the casting structure are achieved, whereby the aluminum alloy casting of the present invention achieves both improvement in strength and reduction of variation in strength.

The second aluminum alloy to which a neutralizing casting defect element is added is low in cost. Further, the aluminum alloy of the present invention enables a reduction of the casting defects when die casting regardless of the shape of the product and achieves increased fineness and increased uniformity of the casting structure, whereby the aluminum alloy casting of the present invention can achieve both an improvement of strength and a reduction of variation in strength.

While the invention has been described with reference to specific embodiments chosen for purpose of illustration, it should be apparent that numerous modifications could be made thereto by those skilled in the art without departing from the basic concept and scope of the invention.

The present disclosure relates to subject matter contained in Japanese Patent Application No. 2002-251956, filed on Aug. 29, 2002, the disclosure of which is expressly incorporated herein by reference in its entirety.

What is claimed is:

1. A hypoeutectic Al—Si alloy casting with low casting defects obtained by casting an aluminum alloy comprised of 9.5 to 11.5 wt % of Si, 3.8 to 4.8 wt % of Cu, 0.45 to 0.65 wt % of Mg, 0.4 to 0.7 wt % of Fe, 0.35 to 0.45 wt % of Mn, and the balance of Al and not more than 0.2 wt % of unavoidable impurities, wherein the hypoeutectic Al—Si alloy contains 0.1 to 1.0 wt % of at least one element selected from the group of second additive elements consisting of Rb, K, Ba, Sr, Zr, Nb, Ta, V, and Pd and at least one element selected from the group of rare earth elements consisting of La, Ce, Pr, Nd, Pm, Sm, Eu, Gd, Tb, Dy, Ho, Er, Tm, Yb, Lu, and Y both added intentionally in order to inhibit casting defects which are attributed to molten hydrogen gas in the alloy casting.

2. The hypoeutectic Al—Si alloy casting as set forth in claim 1, wherein an amount of gas included in said aluminum alloy casting is kept to not more than 1.5 $cm^3$ (standard cubic centimeter) with respect to 100 g of the aluminum alloy casting and said aluminum alloy casting is subject to solution heat treatment, then subject to quench, and then subject to age hardening treatment.

3. The hypoeutectic Al—Si alloy casting as set forth in claim 1, wherein aluminum alloy casting is subject to solution heat treatment at a temperature range of 495 to 505 degree Celsius for 2 to 6 hours, then subject to quench, and further then subject to age hardening treatment at a temperature range of 160 to 220 degree Celsius for 2 to 6 hours.

4. The hypoeutectic Al—Si alloy casting as set forth in claim 3, wherein said aluminum alloy casting treated by solution heat treatment and age hardening treatment has eutectic Si of the particle size of an average not more than 15 micrometer preferably not more than 12 micrometer, a Cu compound of a particle size of not more than an average 8 micrometer, a Mg—Si compound of a particle size of not more than an average 12 micrometer, and an Fe compound of a particle size of not more than an average 6 micrometer.

5. A scroll for a compressor of an air-conditioner made of the hypoeutectic Al—Si alloy casting as set forth in claim 1.

6. A vane rotor of a valve timing regulating device provided in a drive transmission system made of the hypoeutectic Al—Si alloy casting as set forth in claim 1.

7. A housing of an antilock braking system made of the hypoeutectic Al—Si alloy casting as set forth in claim 1.

8. A hypoeutectic Al—Si alloy casting with low casting defects obtained by casting an aluminum alloy comprised of 7.5 to 11.5 wt % of Si, 3.8 to 4.8 wt % of Cu, 0.45 to 0.65 wt % of Mg, 0.4 to 0.7 wt % of Fe, 0.35 to 0.45 wt % of Mn, and the balance of Al and not more than 0.2 wt % of unavoidable impurities, wherein the hypoeutectic Al—Si alloy contains 0.1 to 1.0 wt % of at least one element selected from the group of second additive elements consisting of Rb, K, Ba, Nb, Ta, and Pd and at least one element selected from the group of rare earth elements consisting of La, Ce, Pr, Nd, Pm, Sm, Eu, Gd, Tb, Dy, Ho, Er, Tm, Yb, Lu, Y and Sc both added intentionally in order to inhibit casting defects which are attributed to molten hydrogen gas in the alloy casting;

an amount of gas included in said aluminum alloy casting is kept to not more than 1.5 $cm^3$ (standard cubic centimeter) with respect to 100 g of the aluminum alloy casting; and said aluminum alloy casting is subject to solution heat treatment, then subject to quench, and further then subject to age hardening treatment.

9. The hypoeutectic Al—Si alloy casting as set forth in claim 8, wherein said aluminum alloy casting is subject to solution heat treatment at a temperature range of 495 to 505 degree Celsius for 2 to 6 hours, then subject to quench, and further then subject to age hardening treatment at a temperature range of 160 to 220 degree Celsius for 2 to 6 hours.

10. The hypoeutectic Al—Si alloy casting as set forth in claim 9, wherein said aluminum alloy casting treated by solution heat treatment and age hardening treatment has eutectic Si of a particle size of an average not more than 15 micrometer preferably not more than 12 micrometer, a Cu compound of a particle size of not more than an average 8 micrometer, a Mg—Si compound of a particle size of not more than an average 12 micrometer, and an Fe compound of a particle size or not more than an average 6 micrometer.

11. A scroll for a compressor of an air-conditioner made of the hypoeutectic Al—Si alloy casting as set forth in claim 8.

12. A vane rotor of a valve timing regulating device provided in a drive transmission system made of the hypoeutectic Al—Si alloy casting as set forth in claim 8.

13. A housing of an antilock braking system made of the hypoeutectic Al—Si alloy casting as set forth in claim 8.

* * * * *

UNITED STATES PATENT AND TRADEMARK OFFICE

CERTIFICATE OF CORRECTION

PATENT NO. : 8,246,763 B2
APPLICATION NO. : 12/798288
DATED : August 21, 2012
INVENTOR(S) : Kouji Yamada et al.

It is certified that error appears in the above-identified patent and that said Letters Patent is hereby corrected as shown below:

Col. 14, line 24, claim 3, after “wherein” insert --said--

Signed and Sealed this
Twelfth Day of February, 2013

Teresa Stanek Rea
*Acting Director of the United States Patent and Trademark Office*